US012584467B2

(12) United States Patent
Nishida et al.

(10) Patent No.: US 12,584,467 B2
(45) Date of Patent: Mar. 24, 2026

(54) ROTARY SWASH PLATE HYDRAULIC PUMP

(71) Applicant: KAWASAKI JUKOGYO KABUSHIKI KAISHA, Kobe (JP)

(72) Inventors: Shinji Nishida, Kobe (JP); Isamu Yoshimura, Kobe (JP); Satoru Takao, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 18/852,380

(22) PCT Filed: Mar. 22, 2023

(86) PCT No.: PCT/JP2023/011232
§ 371 (c)(1),
(2) Date: Sep. 27, 2024

(87) PCT Pub. No.: WO2023/189942
PCT Pub. Date: Oct. 5, 2023

(65) Prior Publication Data

US 2025/0188913 A1 Jun. 12, 2025

(30) Foreign Application Priority Data

Mar. 31, 2022 (JP) ..... 2022-061101

(51) Int. Cl.
*F04B 1/182* (2020.01)
*F04B 1/28* (2006.01)

(52) U.S. Cl.
CPC ..... *F04B 1/182* (2013.01); *F04B 1/28* (2013.01)

(58) Field of Classification Search
CPC . F04B 1/14–188; F04B 1/26–295; F04B 1/34
See application file for complete search history.

(56) References Cited

U.S. PATENT DOCUMENTS 2,945,444 A * 7/1960 Leissner ..... F04B 49/18 417/454
3,002,462 A * 10/1961 Raymond ..... F04B 49/08 417/213

(Continued)

FOREIGN PATENT DOCUMENTS

JP S45032181 Y1 12/1970
JP H1182671 A * 3/1999 ..... F04B 1/2042

(Continued)

OTHER PUBLICATIONS

ISA Japan Patent Office, International Search Report Issued in Application No. PCT/JP2023/011232, May 23, 2023, WIPO, 6 pages.

(Continued)

*Primary Examiner* — Thomas Fink
(74) *Attorney, Agent, or Firm* — Alleman Hall LLP

(57) ABSTRACT

This rotary swash plate hydraulic pump includes: a casing; a cylinder block that is disposed in the casing so as to prevent relative rotation of the cylinder block and including a plurality of cylinder bores; a plurality of pistons each of which is inserted into a corresponding one of the plurality of cylinder bores; and a rotary swash plate that is housed in the casing so as to be rotatable about an axis and reciprocates the plurality of pistons. The casing includes an inlet passage that is in the shape of a ring and to which each of the plurality of cylinder bores is connected. The inlet passage is formed on the other side of the cylinder block in an axial direction in the casing and positioned so as to overlap the plurality of cylinder bores.

12 Claims, 6 Drawing Sheets

(56) References Cited

U.S. PATENT DOCUMENTS

| | | | | |
|---|---|---|---|---|
| 3,873,240 | A * | 3/1975 | Leduc | F04B 1/295 417/270 |
| 2015/0159645 | A1 | 6/2015 | Nakaima et al. | |
| 2022/0349398 | A1 * | 11/2022 | Andras | F04B 49/06 |

FOREIGN PATENT DOCUMENTS

| | | | |
|---|---|---|---|
| JP | 2015113766 | A | 6/2015 |
| JP | 2016205266 | A | 12/2016 |

OTHER PUBLICATIONS

ISA Japan Patent Office, Written Opinion Issued in Application No. PCT/JP2023/011232, May 23, 2023, WIPO, 8 pages.

* cited by examiner

ROTARY SWASH PLATE HYDRAULIC PUMP

TECHNICAL FIELD

The present invention relates to a rotary swash plate hydraulic pump in which a rotary swash plate is rotated to reciprocate a plurality of pistons.

BACKGROUND ART

For example, a rotary swash plate piston pump such as that disclosed in Patent Literature (PTL) 1 is known as a piston pump. In the piston pump disclosed in PTL 1, a piston reciprocates when a rotary swash plate rotates. As a result, pressure oil is discharged from the piston pump.

CITATION LIST

Patent Literature

PTL 1: Japanese Laid-Open Patent Application Publication No. 2016-205266

SUMMARY OF INVENTION

Technical Problem

In the piston pump disclosed in PTL 1, an inlet port is connected to a cylinder chamber via a plurality of inlet chambers. The plurality of inlet chambers are formed in a cylinder block. Therefore, the cylinder block is large in size, leading to the enlarged rotary swash plate piston pump.

Thus, an object of the present invention is to provide a rotary swash plate hydraulic pump that can be made compact.

Solution to Problem

A rotary swash plate hydraulic pump according to the present invention includes: a casing; a cylinder block that is disposed in the casing so as to prevent relative rotation of the cylinder block and including a plurality of cylinder bores; a plurality of pistons each of which is inserted into a corresponding one of the plurality of cylinder bores; and a rotary swash plate that is housed in the casing so as to be rotatable about an axis and reciprocates each of the plurality of pistons. The casing includes an inlet passage that is in the shape of a ring and to which each of the plurality of cylinder bores is connected. The inlet passage is formed on the other side of the cylinder block in an axial direction in the casing and overlaps the plurality of cylinder bores as viewed in the axial direction.

According to the present invention, the inlet passage is formed in the casing, on the other side of the cylinder block in the axial direction, and overlaps the plurality of cylinder bores as viewed in the axial direction. Therefore, the inlet passage can be made compact in the radial direction. With this, the rotary swash plate hydraulic pump can be made compact. Furthermore, since the inlet passage is formed in the shape of a ring and positioned so as to overlap the plurality of cylinder bores as viewed in the axial direction, a wide area in the casing that is located on the other side of the cylinder block in the axial direction can be used for the inlet passage. Therefore, the channel area of the inlet passage can be secured. Thus, it is possible to reduce power loss that occurs in the working fluid flowing in the inlet passage.

A rotary swash plate hydraulic pump according to the present invention includes: a casing; a cylinder block that is disposed in the casing so as to prevent relative rotation of the cylinder block and including a plurality of cylinder bores; a plurality of pistons each of which is inserted into a corresponding one of the plurality of cylinder bores; and a rotary swash plate that is housed in the casing so as to be rotatable about an axis and reciprocates each of the plurality of pistons. The casing includes a discharge passage connected to each of the plurality of cylinder bores. The discharge passage is formed in the shape of a ring so as to surround the plurality of cylinder bores.

According to the present invention, the discharge passage is formed in the shape of a ring. Therefore, the discharge passage connected to the plurality of cylinder bores can be easily formed. Furthermore, the discharge passage exteriorly surrounds the plurality of cylinder bores. Therefore, the cylinder bores can be cooled from the outside using the working fluid flowing in the discharge passage.

Advantageous Effects of Invention

According to the present invention, a rotary swash plate hydraulic pump can be made compact.

The above object, other objects, features, and advantages of the present invention will be made clear by the following detailed explanation of preferred embodiments with reference to the attached drawings.

DESCRIPTION OF EMBODIMENTS

Figure 1:
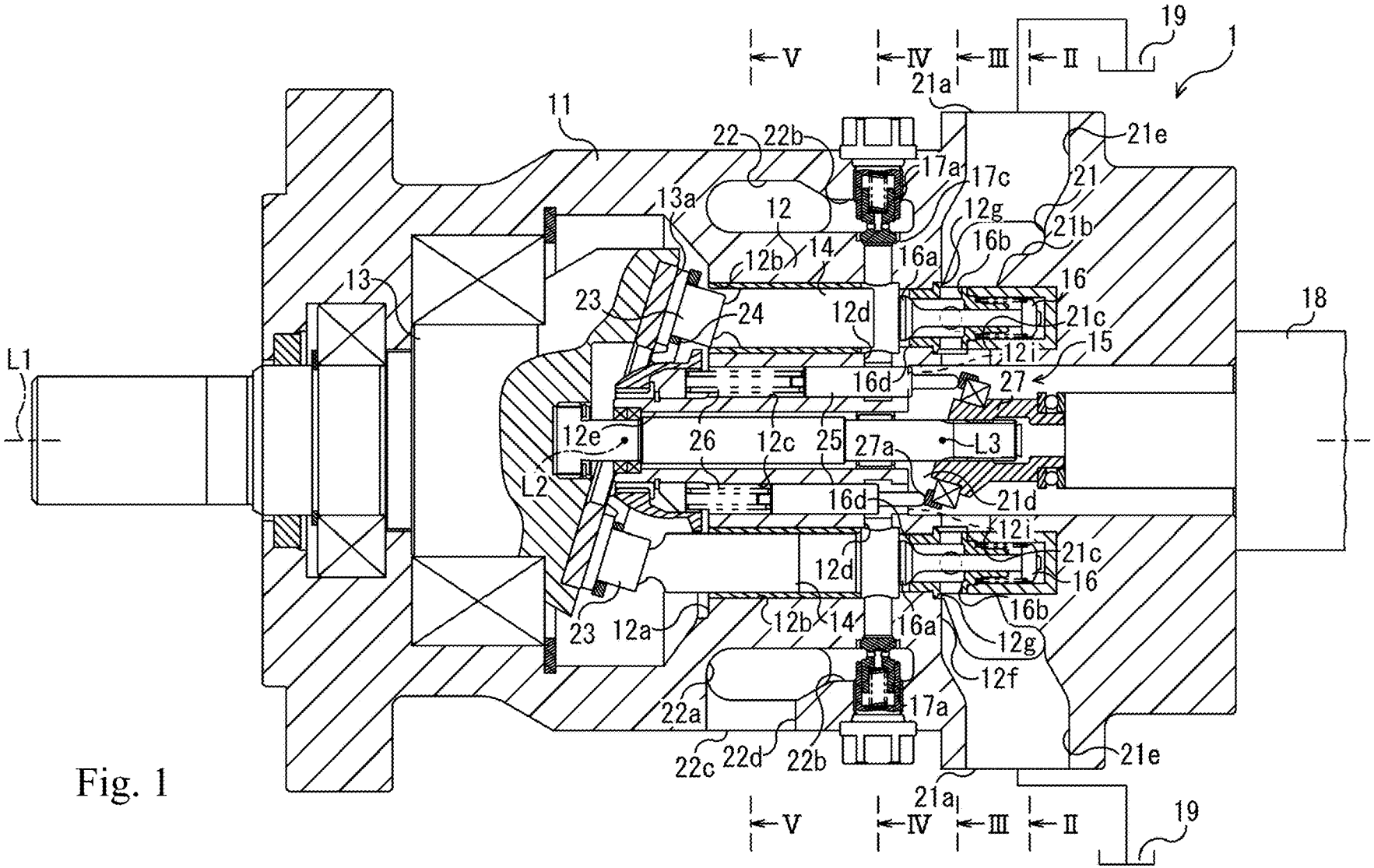
FIG. 1 is a cross-sectional view of a rotary swash plate hydraulic pump according to an embodiment of the present invention.

Hereinafter, a rotary swash plate hydraulic pump 1 according to an embodiment of the present invention will be described with reference to the aforementioned drawings. Note that the concept of directions mentioned in the following description is used for the sake of explanation; the orientations, etc., of elements according to the invention are not limited to these directions. The rotary swash plate hydraulic pump 1 described below is merely one embodiment of the present invention. Thus, the present invention is not limited to the embodiments and may be subject to addition, deletion, and alteration within the scope of the essence of the invention.

Rotary Swash Plate Hydraulic Pump

The rotary swash plate hydraulic pump 1 illustrated in FIG. 1 (hereinafter referred to as "the pump 1") is provided in various machines, for example, construction equipment such as an excavator and a crane, industrial equipment such as a forklift, farm equipment such as a tractor, and hydraulic equipment such as a press machine. In the present embodiment, the pump 1 is a hydraulic pump of the rotary swash plate type with a variable capacity. The pump 1 includes a casing 11, a cylinder block 12, a rotary swash plate 13, a plurality of pistons 14, and a variable capacity mechanism 15. Furthermore, the pump 1 includes a plurality of inlet check valves 16, a plurality of discharge check valves 17, and a linear motion actuator 18. The pump 1 is driven by a drive source (for example, one or both of an engine and an electric motor) to discharge a working fluid.

Casing

The casing 11 houses the cylinder block 12, the rotary swash plate 13, the plurality of pistons 14, and the variable capacity mechanism 15. The casing 11 includes an inlet passage 21 and a discharge passage 22*b*, which will be described in detail later. The casing 11, which is a cylindrical member, extends along a predetermined axis L1.

Cylinder Block

The cylinder block 12 is disposed inside the casing 11 so as to prevent relative rotation thereof. More specifically, the cylinder block 12 is fixed to the casing 11. In the present embodiment, the cylinder block 12 is integrally formed on an axially middle portion of the casing 11. However, the cylinder block 12 may be separate from the casing 11. Note that in the case of being separate, the cylinder block 12 is fixed to the casing 11 by press fitting, spline connection, key connection, fastening, or joining, for example. A plurality of cylinder bores 12*b* which are open on one end surface 12*a* are formed in the cylinder block 12. Note that the one end surface 12*a* is an end surface of the cylinder block 12 that is located on one side in the axial direction. A plurality of spool holes 12*c*, a plurality of communication passages 12*d*, and a shaft insertion hole 12*e* are formed in the cylinder block 12. In the cylinder block 12, the number of cylinder bores 12*b* formed and the number of spool holes 12*c* formed are the same. In the present embodiment, nine cylinder bores 12*b* and nine spool holes 12*c* are formed in the cylinder block 12. Note that the number of cylinder bores 12*b* and the number of nine spool holes 12*c* are not limited to nine.

The cylinder bores 12*b* are arranged circumferentially spaced apart about the axis L1. The cylinder bores 12*b* extend from the one end surface 12*a* to the other end surface 12*f* in the axial direction. Note that the other end surface 12*f* is an end surface of the cylinder block 12 that is located on the other side in the axial direction. The cylinder bores 12*b* include inlet-end openings 12*g* on the other end surface 12*f* of the cylinder block 12.

The spool holes 12*c* are arranged circumferentially spaced apart about the axis L1. The spool holes 12*c* are positioned radially inward of the cylinder bores 12*b*. More specifically, the cylinder block 12 includes, on the one end surface 12*a*, a shaft insertion hole 12 extending about the axis L1, as described later. The spool holes 12*c* are arranged spaced apart from each other about the shaft insertion hole 12*e*. Each of the spool holes 12*c* is associated with a corresponding one of the cylinder bores 12*b*. Each of the spool holes 12*c* is positioned radially inward of the corresponding cylinder bore 12*b*. The spool hole 12*c* includes a drain opening 12*i* on the other end surface 12*f* of the cylinder block 12. The spool hole 12*c* is for releasing part of the capacity of the cylinder bore 12*b*. For example, the diameter of the spool hole 12*c* is smaller than the diameter of the cylinder bore 12*b*.

Each of the communication passages 12*d* connects one of the cylinder bores 12*b* and a corresponding one of the spool holes 12*c*. The communication passages 12*d* extend in the radial direction. The communication passages 12*d* are located on the side of the other end surface 12*f* in the cylinder block 12.

The shaft insertion hole 12*e* is formed along the axis L1 in the cylinder block 12. The shaft insertion hole 12*e* penetrates the cylinder block 12 from the one end surface 12*a* to the other end surface 12*f* in the axial direction.

Rotary Swash Plate

The rotary swash plate 13 includes a rotary swash plate-end inclined surface 13*a*. The rotary swash plate 13 is housed in the casing 11 so as to be rotatable about the axis L1. More specifically, the rotary swash plate 13 is housed on one side in the axial direction in the casing 11. The rotary swash plate 13 extends along the axis L1. The rotary swash plate 13 is supported on the casing 11 so as to be rotatable about the axis L1. The rotary swash plate 13 is disposed so as to face the one end surface 12*a* of the cylinder block 12. One end portion of the rotary swash plate 13 protrudes from an end surface of the casing 11 that is located on one side in the axial direction, that is, one end of the casing 11. In an area located on one side in the axial direction, the one end portion of the rotary swash plate 13 is coupled to the drive source mentioned above. The rotary swash plate 13 is rotatably driven by the drive source. The rotary swash plate 13 rotates to reciprocate the pistons 14, which will be described in detail later. In the rotary swash plate 13, a disc-shaped portion including the rotary swash plate-end inclined surface 13*a* and a shaft portion that is rotatably supported are integrally formed in the present embodiment, but the disc-shaped portion and the shaft portion may be separately formed.

The rotary swash plate-end inclined surface 13*a* is a surface of the rotary swash plate 13 that is formed on the other end thereof. The rotary swash plate-end inclined surface 13*a* faces the one end surface 12*a* of the cylinder block 12. The rotary swash plate-end inclined surface 13*a* is tilted toward the one end surface 12*a* of the cylinder block 12 about a first perpendicular axis L2. The first perpendicular axis L2 is an axis perpendicular to the axis L1. In the present embodiment, the tilt angle of the rotary swash plate-end inclined surface 13*a* is fixed.

Piston

The plurality of pistons 14 are inserted into the corresponding cylinder bores 12*b* of the cylinder block 12. In other words, the same number of pistons 14 as the cylinder bores 12*b* (in the present embodiment, nine pistons 14) are inserted into the cylinder block 12. When the rotary swash plate 13 rotates, each of the pistons 14 reciprocates within the corresponding cylinder bore 12*b*. More specifically, the pistons 14 are in abutment with the rotary swash plate-end inclined surface 13*a*, and the rotary swash plate-end inclined surface 13*a* slides on the pistons 14. When the rotary swash plate 13 rotates, the pistons 14 reciprocate within the cylinder bores 12*b* with a stroke length corresponding to the tilt angle of the rotary swash plate-end inclined surface 13*a*. Note that the pistons 14 are in abutment with the rotary swash plate-end inclined surface 13*a* via shoes 23 in the present embodiment. Each of the shoes 23 is pressed against the rotary swash plate-end inclined surface 13*a* by a pressing plate 24. Thus, when the rotary swash plate 13 rotates, the pistons 14 reciprocate in one axial direction and the other axial direction via the shoes 23.

Variable Capacity Mechanism

The variable capacity mechanism 15 includes a plurality of spools 25, a plurality of springs 26, and a swash plate rotating shaft 27, as illustrated in FIG. 1. In the present embodiment, the variable capacity mechanism 15 includes the same number of spools 25 and springs 26 as the spool holes 12*c*, specifically, nine spools 25 and nine springs 26. The variable capacity mechanism 15 adjusts an effective stroke length S of each of the pistons 14. In the present embodiment, the variable capacity mechanism 15 changes the effective stroke lengths S of the pistons 14 by adjusting the opening and closing of the cylinder bores 12*b*. By changing the effective stroke lengths S, the variable capacity mechanism 15 changes the discharge capacity of the pump 1.

More specifically, the variable capacity mechanism 15 adjusts the opening and closing of the path between the cylinder bore 12*b* and the tank 19 via the spool hole 12*c* and the inlet passage 21 during the travel of the piston 14 from the bottom dead center to the top dead center (in other words, in the discharge process of the pump 1). Thus, the variable capacity mechanism 15 adjusts the effective stroke length S of each of the pistons 14. However, the variable capacity mechanism 15 is not limited to a mechanism that adjusts the effective stroke length S of every piston 14. Note that the aforementioned top dead center is the position of the piston 14 that is at the far end on the other side in the axial direction, and the aforementioned bottom dead center is the position of the piston 14 that is at the far end on one side in the axial direction.

Spool

The spools 25 are arranged corresponding to the cylinder bores 12*b*, respectively. The spool 25 opens and closes the corresponding cylinder bore 12*b*. More specifically, the spool 25 reciprocates to open and close the path between the corresponding cylinder bore 12*b* and the tank 19. The spool 25 adjusts the opening and closing of the path between the cylinder bore 12*b* and the tank 19 in the discharge process. The springs 26 bias the spools 25 toward the swash plate rotating shaft 27 to be described later.

Swash Plate Rotating Shaft

The swash plate rotating shaft 27 rotates in conjunction with the rotary swash plate 13. The swash plate rotating shaft 27 rotates to reciprocate each of the spools 25. Accordingly, the path between the cylinder bore 12*b* and the tank 19 is opened and closed. In the present embodiment, the communication passage 12*d* is opened and closed. Furthermore, the swash plate rotating shaft 27 can change the opening/closing position of each of the spools 25. The opening/closing position of each of the spools 25 is a position at which the spool 25 starts opening the communication passage 12*d* and a position at which the spool 25 starts closing the communication passage 12*d*.

More specifically, the swash plate rotating shaft 27 includes a swash plate rotating shaft-end inclined surface 27*a*. The swash plate rotating shaft 27 is inserted through the shaft insertion hole 12*e* of the cylinder block 12 and extends along the axis L1. One axial end portion of the swash plate rotating shaft 27 protrudes from the shaft insertion hole 12*e* toward the rotary swash plate 13. The one axial end portion of the swash plate rotating shaft 27 is coupled to the rotary swash plate 13 so as to prevent relative rotation thereof. Therefore, the swash plate rotating shaft 27 rotates about the axis L1 in conjunction with the rotary swash plate 13. The other axial end portion of the swash plate rotating shaft 27 also protrudes from the shaft insertion hole 12*e* toward the inlet passage 21 to be described later.

The swash plate rotating shaft-end inclined surface 27*a* is located on an axially middle portion of the swash plate rotating shaft 27. The swash plate rotating shaft-end inclined surface 27*a* is disposed so as to face the other end of the cylinder block 12. More specifically, the swash plate rotating shaft-end inclined surface 27*a* faces the drain opening 12*i* of each of the spool holes 12*c*. The swash plate rotating shaft-end inclined surface 27*a* is tilted about a second perpendicular axis L3 parallel to the first perpendicular axis L2. The second perpendicular axis L3 is also an axis perpendicular to the axis L1. In the present embodiment, the swash plate rotating shaft-end inclined surface 27*a* is tilted in the same direction as the rotary swash plate-end inclined surface 13*a*, in other words, clockwise about the second perpendicular axis L3. The tilt angle of the swash plate rotating shaft-end inclined surface 27*a* is fixed. The other axial ends of the spools 25 that are biased by the springs 26 are in abutment with the swash plate rotating shaft-end inclined surface 27*a*. The swash plate rotating shaft-end inclined surface 27*a* slidably rotates on the spools 25. Therefore, when the swash plate rotating shaft-end inclined surface 27*a* rotates, the spools 25 reciprocate within the spool holes 12*c* with a stroke length corresponding to the tilt angle of the swash plate rotating shaft-end inclined surface 27*a*.

The swash plate rotating shaft-end inclined surface 27*a* can move back and forth in the axial direction. By moving back and forth, the swash plate rotating shaft-end inclined surface 27*a* adjusts the opening and closing of the path between the cylinder bore 12*b* and the tank 19. More specifically, the swash plate rotating shaft-end inclined surface 27*a* moves back and forth to adjust the opening/closing position of the spool 25. The linear motion actuator 18 is connected to the other axial end portion of the swash plate rotating shaft 27. Note that the linear motion actuator 18 may either be an electric linear motion actuator or a hydraulic linear motion actuator. The linear motion actuator 18 allows the swash plate rotating shaft-end inclined surface 27*a* to move back and forth so as to move toward and away from the other end surface 12*f* of the cylinder block 12. Thus, it is possible to change the dead center position (more specifically, the axial position of the dead center) of the spool 25 in the cylinder bore 12*b*. For example, when the swash plate rotating shaft-end inclined surface 27*a* moves forward in one axial direction, the dead center position of the spool 25 in the cylinder bore 12*b* shifts in the one axial direction. On the other hand, when the swash plate rotating shaft-end inclined surface 27*a* moves backward in the other axial direction, the dead center position of the spool 25 in the cylinder bore 12*b* shifts in the other axial direction. Therefore, the opening/closing position of the spool 25 in the cylinder bore 12*b* can be shifted in the axial direction.

The effective stroke length S of the piston 14 is a range of stroke in which the working fluid can be discharged from the cylinder bore 12*b*. Therefore, by shifting the opening/closing position of the spool 25 in the axial direction, it is possible to change the effective stroke length S of the piston 14. Thus, it is possible to change the discharge capacity of the cylinder bore 12*b* by moving the swash plate rotating shaft-end inclined surface 27*a* back and forth in the axial direction.

Inlet Passage

Figure 2:
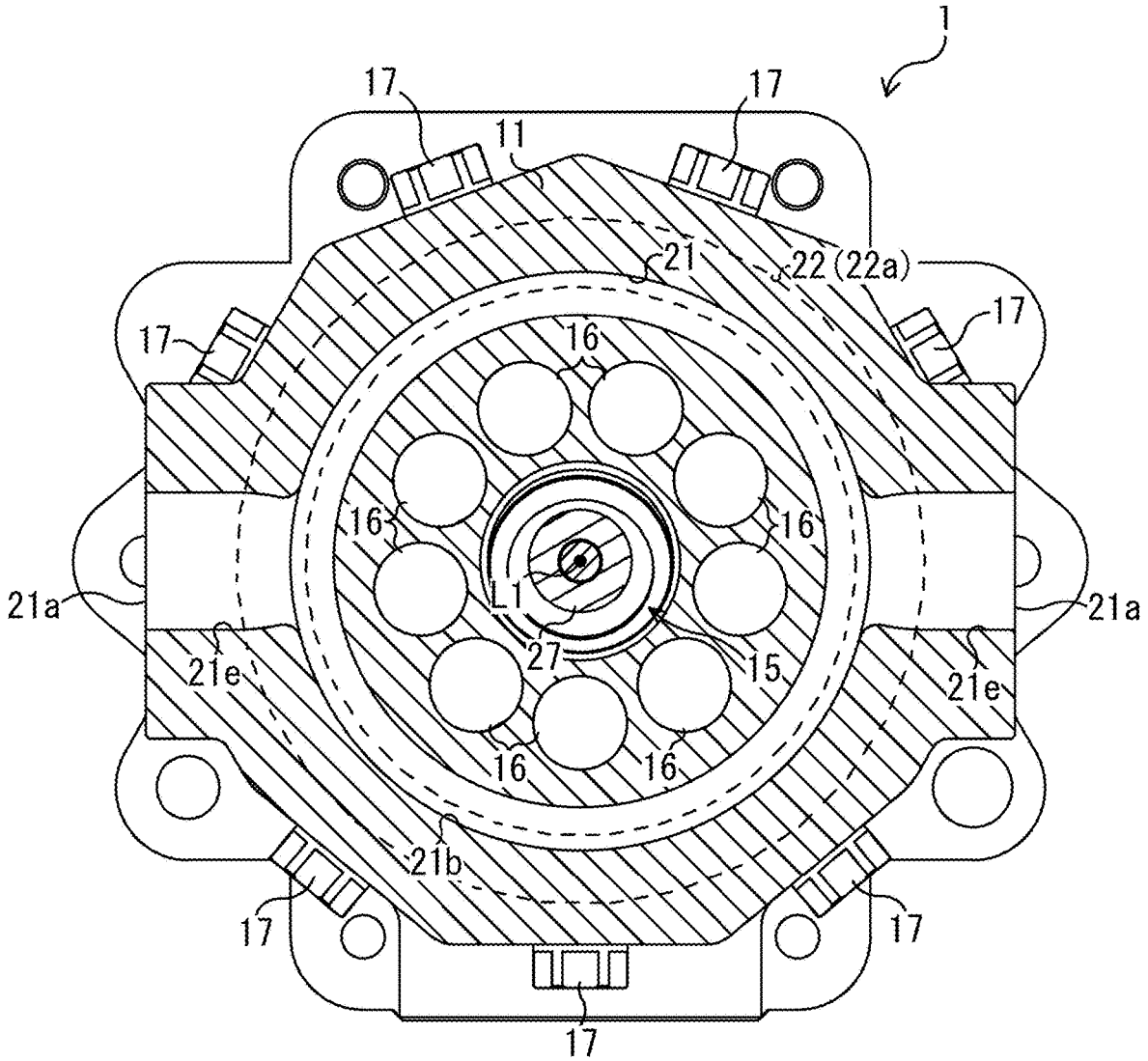
FIG. 2 is a cross-sectional view of the rotary swash plate hydraulic pump taken along the section line II-II indicated in FIG. 1.
Figure 3:
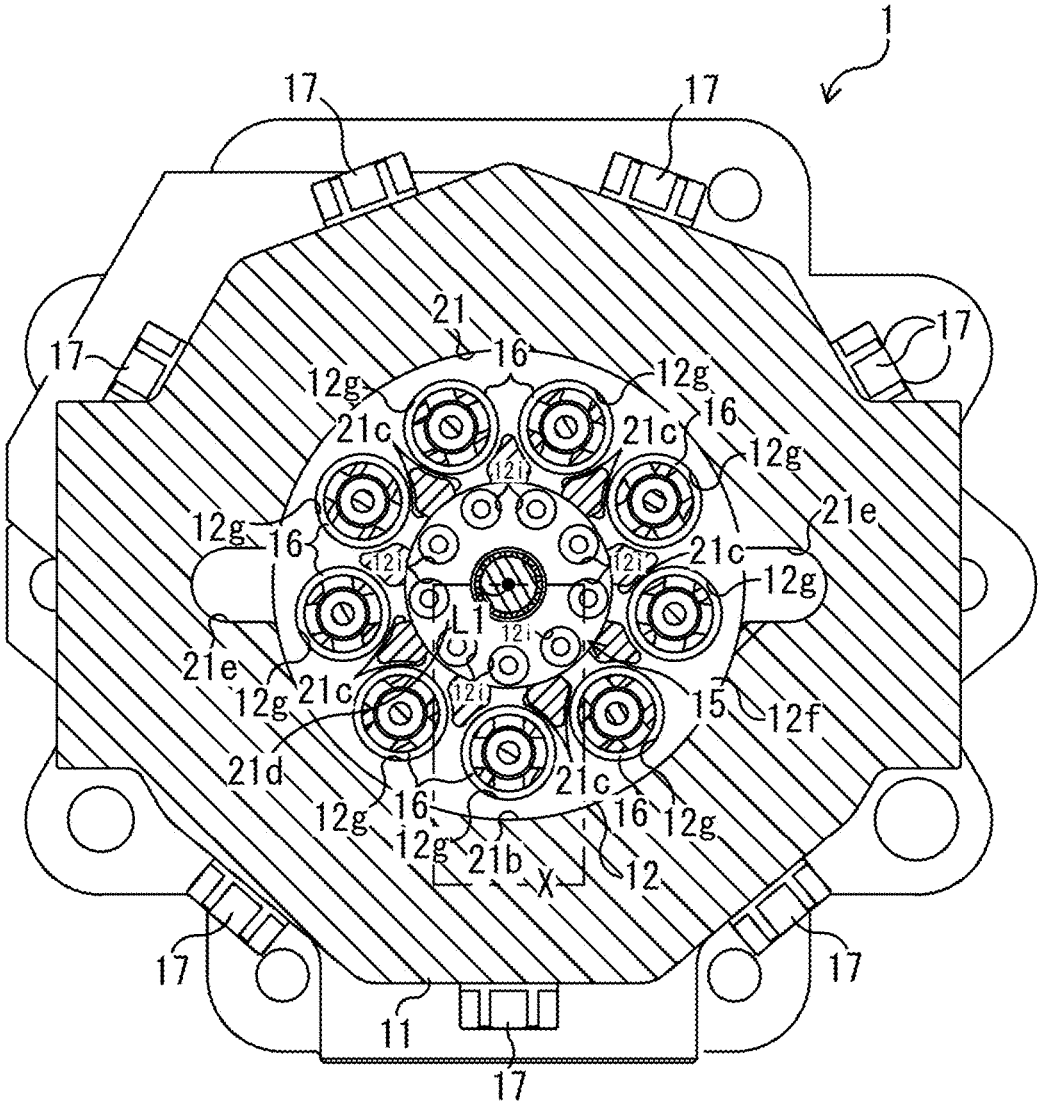
FIG. 3 is a cross-sectional view of the rotary swash plate hydraulic pump taken along the section line III-III indicated in FIG. 1.

As illustrated in FIG. 1 to FIG. 3, the inlet passage 21 includes a plurality of inlet ports 21*a*, a plurality of inlet-end ring-shaped portions 21*b*, a plurality of communication portions 21*c*, and a communication chamber 21*d*. The inlet passage 21 is formed on the other side of the cylinder block 12 in the axial direction in the casing 11. The inlet passage 21 is connected to the tank 19 and is also connected to the cylinder bores 12*b* (refer to FIG. 1). The working fluid is drawn from the tank 19 into the cylinder bores 12*b* via the inlet passage 21.

The inlet passage 21 is formed in the shape of a ring as viewed in the axial direction. The inlet passage 21 herein is formed in the shape of a circular ring centered on the axis L1. The inlet passage 21 surrounds the swash plate rotating shaft 27. The inlet passage 21 overlaps each of the cylinder bores 12*b* as viewed in the axial direction. The inlet passage 21 is connected to the cylinder bores 12*b* in the axial direction. More specifically, the inlet passage 21 overlaps each of the inlet-end openings 12*g* of the cylinder bores 12*b* as viewed in the axial direction. The inlet passage 21 is connected to the cylinder bores 12*b* via the inlet-end openings 12*g*.

The inlet passage 21 also overlaps each of the spool holes 12*c* as viewed in the axial direction. More specifically, the inlet passage 21 overlaps each of the drain openings 12*i* of the spool holes 12*c* as viewed in the axial direction. Each of the drain openings 12*i* is connected to the tank 19 via the inlet passage 21.

The plurality of inlet ports 21*a* are connected to the tank 19 (refer to FIG. 1). As illustrated in FIG. 2, two inlet ports 21*a* are formed in the outer peripheral surface of the casing 11. Note that the number of inlet ports 21*a* formed in the casing 11 is not limited to two and may be one or greater than or equal to three. Each of the inlet ports 21*a* is formed in the outer peripheral surface of the casing 11, at the other axial end thereof. The plurality of inlet ports 21*a* are spaced apart at equal distances in the circumferential direction as viewed in the axial direction. In the present embodiment, the two inlet ports 21*a* are spaced part by 180 degrees.

As illustrated in FIG. 2 and FIG. 3, the inlet-end ring-shaped portion 21*b* is formed in the shape of a ring as viewed in the axial direction. The inlet-end ring-shaped portion 21*b* herein is formed in the shape of a circular ring centered on the axis L1. The inlet-end ring-shaped portion 21*b* is formed extending to the other end surface 12*f* of the cylinder block 12, as illustrated in FIG. 3. In the present embodiment, the other end surface 12*f* of the cylinder block 12 faces the inlet-end ring-shaped portion 21*b* (in other words, the inlet passage 21). The inlet-end ring-shaped portion 21*b* overlaps each of the cylinder bores 12*b* as viewed in the axial direction. More specifically, as viewed in the axial direction, the inlet-end ring-shaped portion 21*b* overlaps each of the inlet-end openings 12*g* of the cylinder bores 12*b*, and each of the inlet-end openings 12*g* of the cylinder bores 12*b* faces the inlet-end ring-shaped portion 21*b*. In the present embodiment, at a position adjacent to the other end surface 12*f*, an outer-diameter portion of the inlet-end ring-shaped portion 21*b* extends in an area that is radially outside of the cylinder bores 12*b*. An inner-diameter portion of the inlet-end ring-shaped portion 21*b* is formed following the shape of the cylinder bores 12*b*. In the inlet-end ring-shaped portion 21*b*, a plurality of passage portions 21*e* are formed at equal distances in the circumferential direction as viewed in the axial direction. The passage portions 21*e* are arranged corresponding to the inlet ports 21*a*, respectively. In the present embodiment, two passage portions 21*e* are formed on the inlet-end ring-shaped portion 21*b*. The inlet-end ring-shaped portion 21*b* is connected to each of the inlet ports 21*a* via a corresponding one of the passage portions 21*e*. The outer and inner diameters of the inlet-end ring-shaped portion 21*b* are constant in an area on the other side in the axial direction and are reduced radially inward from an axially middle portion thereof toward an area on one side in the axial direction. Therefore, the drawn working fluid can be smoothly brought to the cylinder bores 12*b*.

Each of the communication portions 21*c* is connected to the inlet-end ring-shaped portion 21*b*. In the casing 11, the same number of communication portions 21 as the number of spool holes 12*c* are formed. Note that the number of communication portions 21*c* is not limited to being the same as the number of spool holes 12*c*. The communication portions 21*c* extend from the inlet-end ring-shaped portion 21*b* toward the spool holes 12*c* as viewed in the axial direction. More specifically, the communication portions 21*c* are radially arranged so as to extend radially outward from the drain openings 12*i* of the spool holes 12*c*.

The communication chamber 21*d* is formed in the shape of a ring as viewed in the axial direction. More specifically, the communication chamber 21*d*, which is in the shape of a circular ring centered on the axis L1, is located about the swash plate rotating shaft 27. The communication chamber 21*d* is positioned inward of the inlet-end ring-shaped portion 21*b* so as to overlap each of the spool holes 12*c*. More specifically, the communication chamber 21*d* is positioned inward of the inlet-end ring-shaped portion 21*b* so as to overlap the drain openings 12*i* of the spool holes 12*c*. The outer-diameter portion of the communication chamber 21*d* is formed so as to circumscribe the spool holes 12*c* as viewed in the axial direction. The communication chamber 21*d* is connected to the communication portions 21*c* and is connected to the inlet-end ring-shaped portion 21*b* via the communication portions 21*c*.

Discharge Passage

Figure 4:
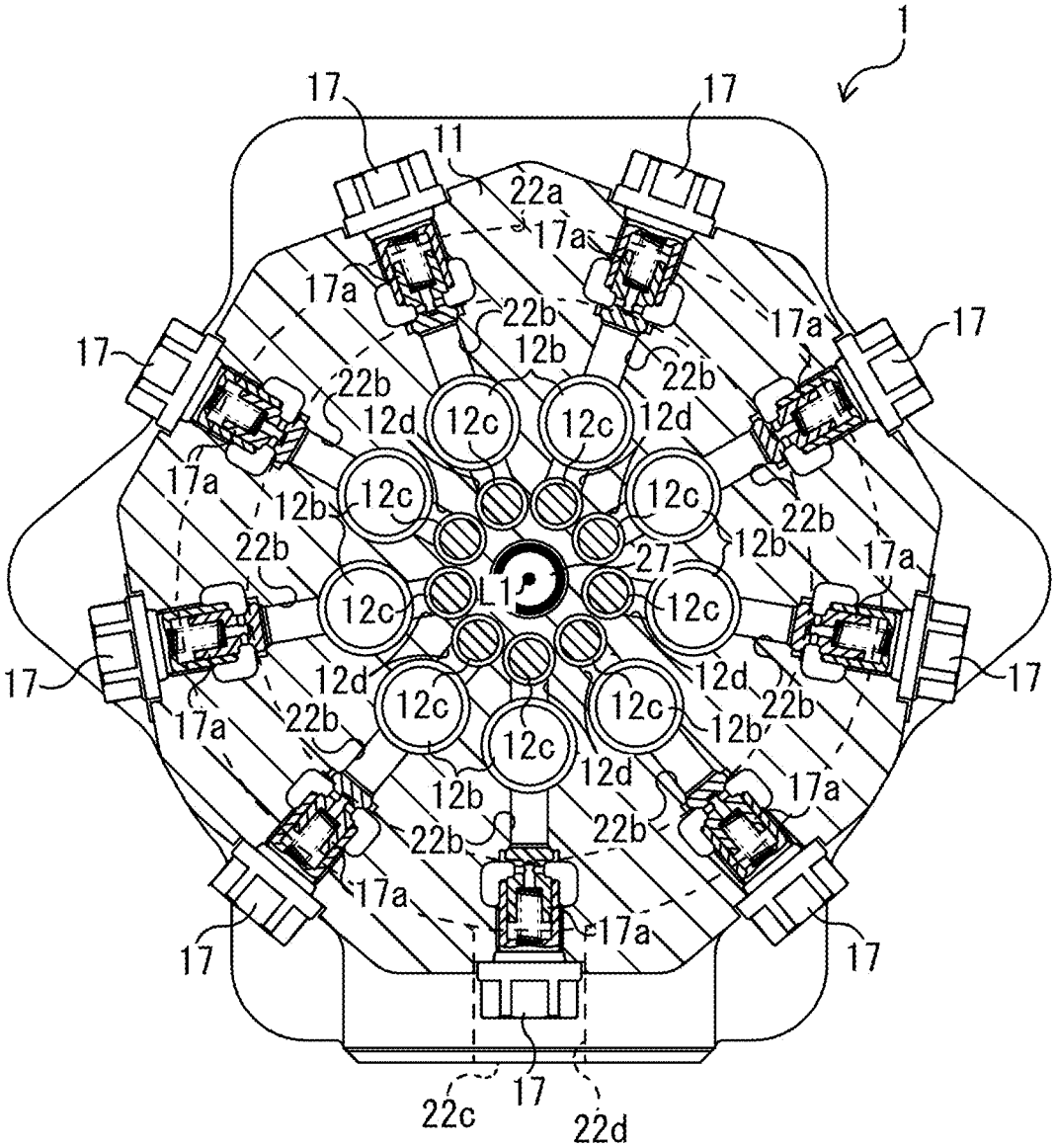
FIG. 4 is a cross-sectional view of the rotary swash plate hydraulic pump taken along the section line IV-IV indicated in FIG. 1.
Figure 5:
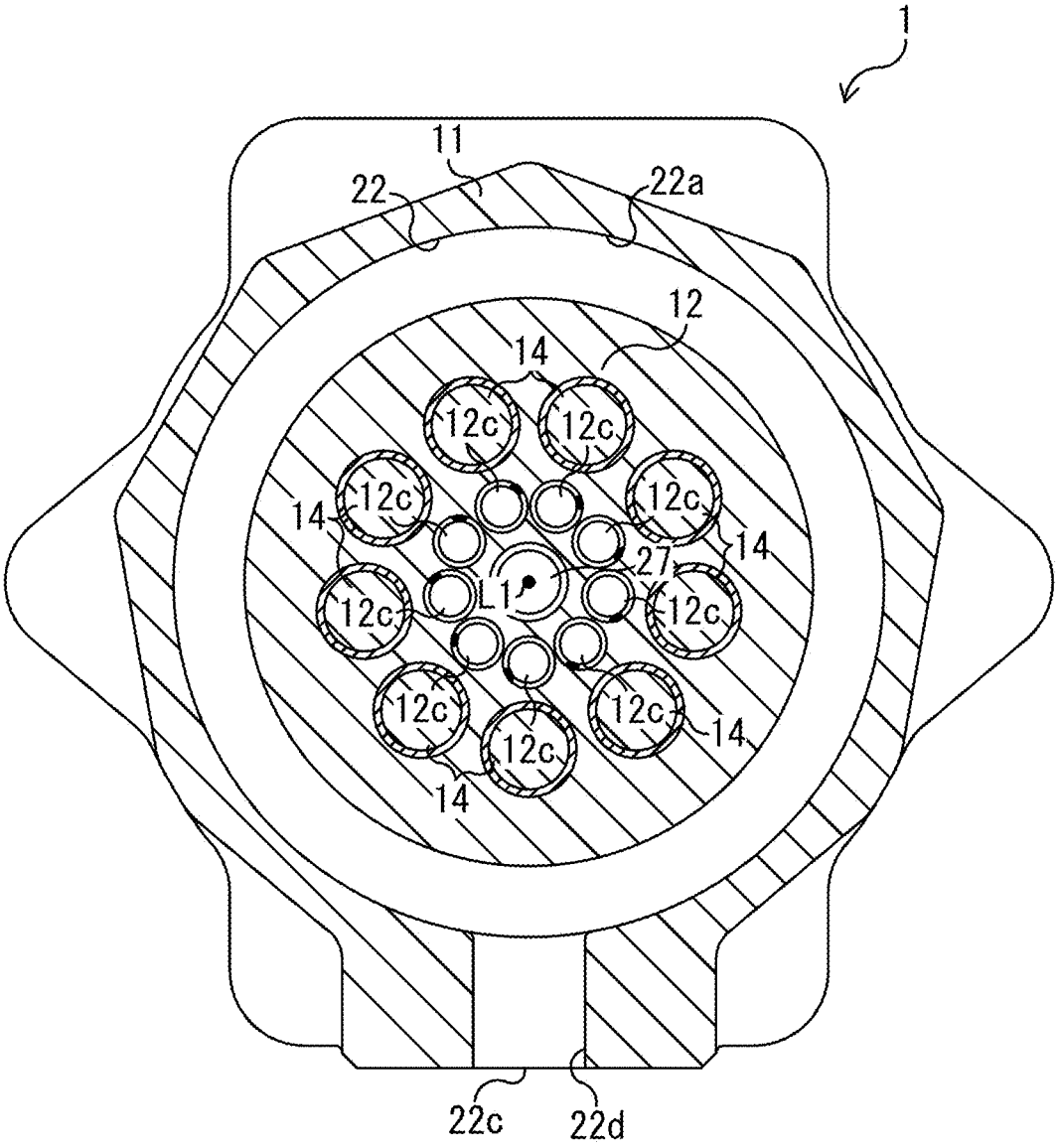
FIG. 5 is a cross-sectional view of the rotary swash plate hydraulic pump taken along the section line V-V indicated in FIG. 1.

As illustrated in FIG. 1, FIG. 4, and FIG. 5, the discharge passage 22 includes a discharge-end ring-shaped portion 22*a*, a plurality of discharge-end branch portions 22*b*, a discharge port 22*c*, and a merge portion 22*d*. The discharge passage 22 is formed in an axially middle portion of the casing 11. As illustrated in FIG. 5, the discharge passage 22 is formed in the shape of a ring. More specifically, the discharge passage 22, which is formed in the shape of a circular ring in the casing 11, exteriorly surrounds the plurality of cylinder bores 12*b*. In the present embodiment, the discharge passage 22 is formed having a diameter greater than the diameter of the inlet passage 21 (refer to the dotted lines in FIG. 2). Here, at least the outermost diameter of the discharge passage 22 is set greater than the outermost diameter of the inlet passage 21. The discharge passage 22 is connected to each of the cylinder bores 12*b*. The pump 1 discharges the working fluid via the discharge passage 22 and the discharge port 22*c*.

As illustrated in FIG. 5, the discharge-end ring-shaped portion 22*a* is formed in the shape of a ring as viewed in the axial direction. The discharge-end ring-shaped portion 22*a* herein is formed in the shape of a circular ring centered on the axis L1. The discharge-end ring-shaped portion 22*a* exteriorly surrounds the plurality of cylinder bores 12*b*. The discharge-end ring-shaped portion 22*a* is formed having a diameter greater than the diameter of the inlet-end ring-shaped portion 21*b* (refer to the dotted line in FIG. 2). The discharge-end ring-shaped portion 22*a* is formed on one side of the communication passage 12*d* in the axial direction in the casing 11. More specifically, the plurality of discharge check valves 17, which will be described in detail later, are arranged between the discharge-end ring-shaped portion 22*a* and the inlet-end ring-shaped portion 21*b* in the axial direction.

The plurality of discharge-end branch portions 22*b* extend from the corresponding cylinder bores 12*b* toward the discharge-end ring-shaped portion 22*a*. The same number of discharge-end branch portions 22*b* as the cylinder bores 12*b* are formed in the casing 11. The discharge-end branch portions 22*b* are in one-to-one correspondence with the cylinder bores 12*b*. The discharge-end branch portions 22*b* extend radially outward from the corresponding cylinder bores 12*b*. The discharge-end branch portions 22*b* extend radially, are further bent, and extend in the one axial direction toward the discharge-end ring-shaped portion 22*a*. The discharge-end branch portions 22*b* are connected at positions circumferentially spaced apart from each other at equal distances in the discharge-end ring-shaped portion 22*a*.

The discharge port 22*c* discharges the working fluid. In the present embodiment, there is one discharge port 22*c* in the casing 11. Note that there may be more than one discharge port 22*c*. The discharge port 22*c* is connected to a hydraulic actuator, for example. The discharge port 22*c* is formed in the outer peripheral surface of the casing 11, at an axially middle portion thereof. In the present embodiment, the discharge port 22*c* is placed at a position that is 90 degrees offset from each of the two inlet ports 21*a* in the circumferential direction as viewed in the axial direction. In other words, the discharge port 22*c* and the inlet ports 21*a* are at different positions in the circumference direction centered on the axis L1. Note that in FIG. 1, for the sake of explanation, the discharge port 22*c* and one of the inlet ports 21*a* are placed at positions that are the same in the circumferential direction.

The merge portion 22*d* connects the discharge-end ring-shaped portion 22*a* and the discharge port 22*c*. The merge portion 22*d* is disposed at a position at which the pulsations of the working fluid discharged from the plurality of cylinder bores 12*b* are canceled out. More specifically, the merge portion 22*d* is connected to one of the discharge-end branch portions 22*b* in the discharge-end ring-shaped portion 22*a*, at a position that is the same in the circumferential direction centered on the axis L1. The position that is the same herein is not limited to the completely same position. For example, it is sufficient that the merge portion 22*d* and the discharge-end branch portion 22*b* at least partially overlap each other in the radial direction. The working fluid flowing from the discharge-end branch portion 22*b* connected at the same position flows directly to the merge portion 22*d*. Meanwhile, the working fluid brought from the other eight discharge-end branch portions 22*b* to the discharge-end ring-shaped portion 22*a* is divided and flows clockwise and counterclockwise in the discharge-end ring-shaped portion 22*a*, and then streams of the working fluid merge at the merge portion 22*d*. Thus, the pulsations of the working fluid are cancelled out at the time of merging. Note that the position of the merge portion 22*d* is not limited to that described earlier. For example, there may be more than one discharge port 22*c* and more than one merge portion 22*d* in the casing 11. For example, the merge portions 22*d* are connected to some of the discharge-end branch portions 22*b* at positions that are the same in the circumferential direction centered on the axis L1. The remaining discharge-end branch portions 22*b* are arranged at positions that are not 180 degrees offset from the merge portions 22*d*.

Inlet Check Valve

Figure 6:
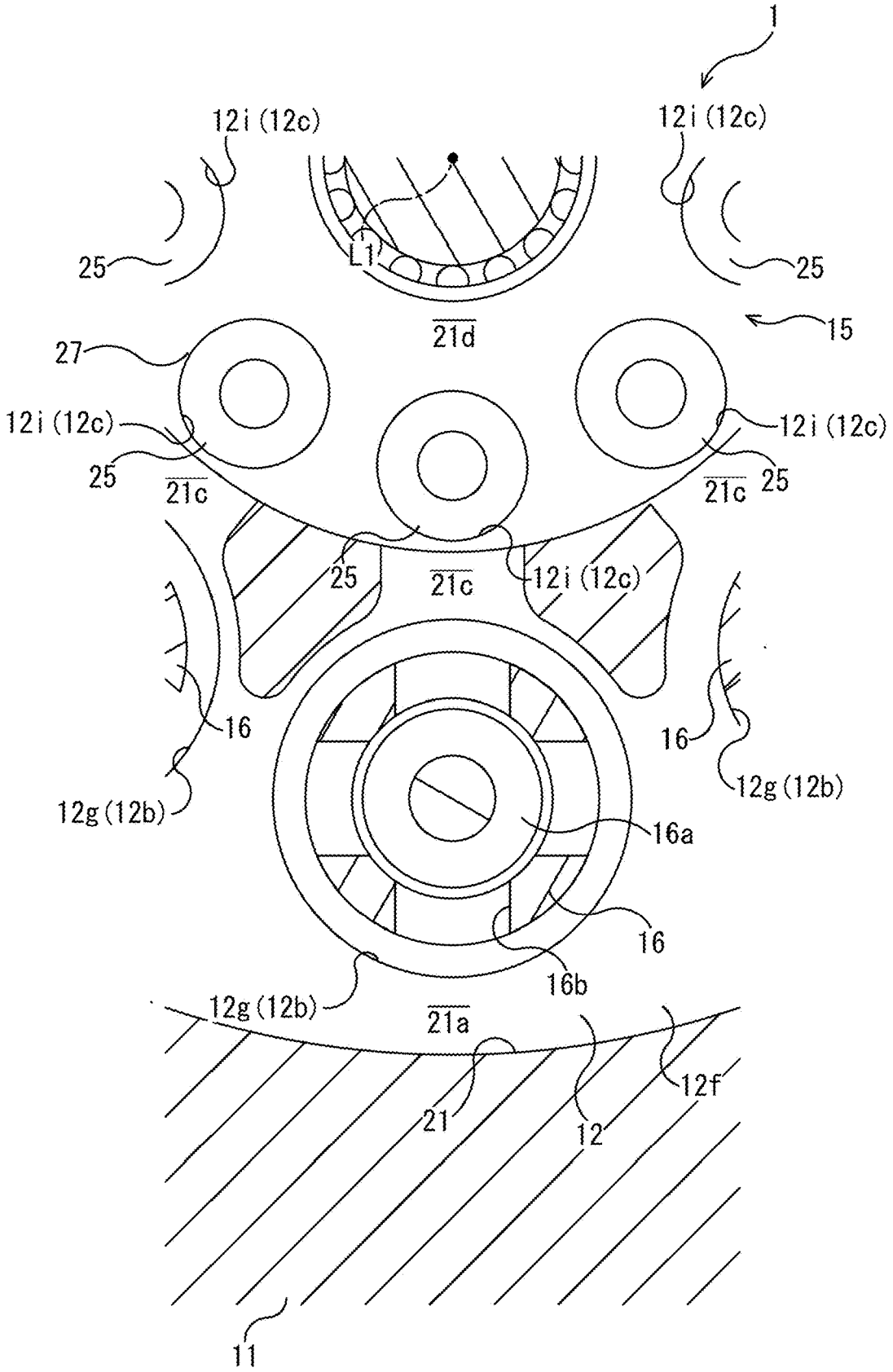
FIG. 6 is an enlarged cross-sectional view of a region X illustrated in FIG. 3.

Each of the inlet check valves 16 is provided on a corresponding one of the cylinder bores 12*b*, as illustrated in FIG. 1. This means that there are the same number of inlet check valves 16 as the cylinder bores 12*b*, specifically, nine inlet check valves 16, in the present embodiment. More specifically, each of the inlet check valves 16 is inserted into the corresponding cylinder bore 12*b* on the other side in the axial direction. In the present embodiment, the inlet check valve 16 has one end portion thereof inserted into the inlet-end opening 12*g*, as illustrated in FIG. 3. The other end portion of each of the inlet check valves 16 protrudes from the inlet-end opening 12*g* of the corresponding cylinder bore 12*b* to the inlet passage 21, more specifically, to the inlet-end ring-shaped portion 21*b*. In the inlet check valve 16, an inner passage 16*b* is formed, as illustrated in FIG. 6. The inlet-end ring-shaped portion 21*b* is connected to the cylinder bore 12*b* via the inner passage 16*b*. The inner passage 16*b* of each of the inlet check valves 16 is open in a corresponding one of the communication portions 21*c*. Therefore, the inlet-end ring-shaped portion 21*b* is always connected to the spool holes 12*c*.

Using a check valve body 16*a*, the inlet check valve 16 opens and closes the path between the inlet-end ring-shaped portion 21*b* and the cylinder bore 12*b*, as illustrated in FIG. 1. More specifically, the inlet check valve 16 opens and closes the inner passage 16*b* using the check valve body 16*a*. Thus, the inlet check valve 16 opens and closes the path between the inlet passage 21 and the cylinder bore 12*b*. The check valve body 16*a* moves in the axial direction. The check valve body 16*a* extends in the axial direction, and a portion thereof on the other side in the axial direction protrudes from the cylinder bore 12*b*. A spring 16*c* is provided on the protruding portion of the check valve body 16*a*, and the check valve body 16*a* is biased by the spring 16*c* in a closing direction. The spring 16*c* herein is disposed on the upstream side of a valve seat 16*d* of the inlet check valve 16. The inlet check valve 16 opens and closes to allow the flow of the working fluid in one direction from the inlet passage 21 to the cylinder bore 12*b* and block the opposite flow of the working fluid. Therefore, in the intake process in which the piston 14 moves from the top dead center to the bottom dead center, the working fluid flows from the inlet passage 21 to the cylinder bore 12*b*. On the other hand, in the discharge process, the flow of the working fluid from the inlet passage 21 to the cylinder bore 12*b* is stopped.

Discharge Check Valve

Each of the plurality of discharge check valves 17 is provided on a corresponding one of the cylinder bores 12*b*, as illustrated in FIG. 4. This means that there are the same number of discharge check valves 17 as the discharge-end branch portions 22*b*, specifically, nine discharge check valves 17, in the present embodiment. More specifically, each of the nine discharge check valves 17 is provided on a corresponding one of the discharge-end branch portions 22*b* of the discharge passage 22. In the present embodiment, each of the discharge check valves 17 is inserted from the outer peripheral surface of the casing 11 into a radially extending portion of the corresponding discharge-end branch portion 22*b*. The discharge check valve 17 opens and closes the discharge passage 22. More specifically, using a check valve body 17*a*, the discharge check valve 17 opens and closes the discharge-end branch portion 22*b* (more specifically, the radially extending portion thereof). Thus, the discharge check valve 17 can open and close the discharge passage 22 at a position away from the discharge-end ring-shaped portion 22*a*. This leads to less impact from the working fluid that is brought from another cylinder bore 12*b* to the discharge-end ring-shaped portion 22*a* regarding the opening/closing operation of the discharge check valve 17.

The check valve body 17*a* moves in a radial direction different from the direction in which the check valve body 16*a* moves. The check valve body 17*a* extends in the radial direction, and on a radially outer portion thereof, a spring 17*b* is provided. The spring 17*b* herein is disposed on the downstream side of a valve seat 17*c* of the discharge check valve 17. The check valve body 17*a* opens the discharge passage 22 in the discharge process. Therefore, the discharge check valve 17 allows the flow of the working fluid in one direction from the cylinder bore 12*b* to the discharge-end ring-shaped portion 22 (or the discharge port 22*c*) in the discharge process. On the other hand, the discharge check valve 17 blocks the opposite flow of the working fluid. Therefore, in the intake process, the flow of the working fluid from the cylinder bore 12*b* to the discharge port 22*c* is stopped.

Operation of Pump

Next, the operation of the pump 1 will be described. When the drive source rotatably drives the rotary swash plate 13, each of the pistons 14 reciprocates within the corresponding cylinder bore 12*b* accordingly. Thus, the piston 14 draws the working fluid from the inlet passage 21 into the cylinder bore 12*b* via the inlet check valve 16 in the intake process. More specifically, the working fluid is drawn from the inlet ports 21*a* into the inlet-end ring-shaped portion 21*b* via the passage portions 21*e*. Subsequently, the working fluid is brought from the inlet-end ring-shaped portion 21*b* to the cylinder bores 12*b* via the inlet check valves 16. In the present embodiment, the working fluid is drawn from the two inlet ports 21*a* into the inlet-end ring-shaped portion 21*b*. Therefore, there is less variation in the distance between each of the cylinder bores 12*b* and the closest inlet port 21*a*. This results in less per-cylinder bore 12*b* variation in power loss occurring in the working fluid that is distributed to each of the cylinder bores 12*b*. Thus, the failure to open the inlet check valve 16 due to a deficiency in the suction force is reduced.

Each of the pistons 14 discharges the working fluid from the corresponding cylinder bore 12*b* via the corresponding discharge check valve 17 and the discharge passage 22. More specifically, when the working fluid in the cylinder bore 12*b* is pressurized by the piston 14 in the discharge process, the discharge check valve 17 eventually opens the discharge passage 22. Thus, the working fluid is brought from the cylinder bore 12*b* to the discharge-end ring-shaped portion 22*a* via the discharge-end branch portion 22*b*. In the discharge-end ring-shaped portion 22*a*, the working fluid from the discharge-end branch portions 22*b* is divided as a stream flowing clockwise and a stream flowing counterclockwise as viewed in the axial direction. Subsequently, the divided streams of the working fluid merge at the discharge port 22*c* and are then discharged from the discharge port 22*c*.

Furthermore, in the pump 1, when the swash plate rotating shaft 27 rotates in conjunction with the rotation of the rotary swash plate 13, each of the spools 25 reciprocates within the corresponding spool hole 12*c* in synchronization with the corresponding piston 14. As a result, the communication passage 12*d* is opened midway through the intake process of the piston 14, and the communication passage 12*d* is closed midway through the discharge process of the piston 14. Thus, the cylinder bore 12*b* and the communication passage 12*d* are in communication until the communication passage 12*d* is closed (in other words, until the piston 14 travels the open stroke length S2) in the discharge process. The discharge of the working fluid from the cylinder bore 12*b* to the discharge port 22*c* is limited until the communication passage 12*d* is closed. Therefore, the effective stroke length S of each of the pistons 14 is less than the actual stroke length S1 by the open stroke length S2, and the pump 1 discharges an amount of the working fluid that corresponds to the effective stroke length S. In the pump 1, the linear motion actuator 18 moves the swash plate rotating shaft-end inclined surface 27*a* in the axial direction, and thus the opening/closing position of each of the spools 25 is changed. As a result, the effective stroke length S of each of the pistons 14 can be changed, meaning that the discharge capacity of the pump 1 is increased or decreased.

In the pump 1 according to the present embodiment, the inlet passage 21 is formed on the other side of the cylinder block 12 in the axial direction in the casing 11 and overlaps the plurality of cylinder bores 12*b* as viewed in the axial direction. Therefore, the inlet passage 21 can be made compact in the radial direction. Accordingly, the pump 1 can be made compact. Furthermore, since the inlet passage 21 is formed in the shape of a ring and positioned so as to overlap the plurality of cylinder bores 12*b* as viewed in the axial direction, a wide area in the casing 11 that is located on the other side of the cylinder block 12 in the axial direction can be used for the inlet passage 21. Therefore, the channel area of the inlet passage 21 can be secured. Thus, it is possible to reduce power loss that occurs in the working fluid flowing in the inlet passage 21.

Furthermore, in the pump 1 according to the present embodiment, the spool holes 12*c* are connected to the inlet passage 21. Therefore, there is no need to provide an additional passage connected to the spool holes 12*c*. Thus, the casing 11 can be made compact.

Furthermore, in the pump 1 according to the present embodiment, the communication chamber 21*d* is formed inward of the inlet-end ring-shaped portion 21*b*. Therefore, the inside of the inlet-end ring-shaped portion 21 can be effectively used.

Furthermore, in the pump 1 according to the present embodiment, two inlet ports 21*a* are formed in the outer peripheral surface of the casing 11. Therefore, it is possible to reduce variations in the difference between the shortest paths from one of the inlet ports 21*a* to the cylinder bores 12*b*. Thus, it is possible to reduce power loss that occurs in the working fluid flowing in the inlet passage 21.

Furthermore, in the pump 1 according to the present embodiment, the discharge passage 22 is formed in the shape of a ring. Therefore, the pulsations of the working fluid discharged from the nine cylinder bores 12*b* can be cancelled out. Thus, it is possible to reduce the occurrence of pulsations of the working fluid discharged.

Furthermore, in the pump 1 according to the present embodiment, the discharge passage 22 is offset with respect to the inlet passage 21 in the axial direction. Therefore, the discharge passage 22 and the inlet passage 21 can partially overlap each other as viewed in the axial direction. Accordingly, the pump 1 can be made compact in the radial direction.

Furthermore, in the pump 1 according to the present embodiment, the discharge passage 22 exteriorly surrounds the nine cylinder bores 12*b*. Therefore, the cylinder bores 12*b* can be cooled from the outside using the working fluid flowing in the discharge passage 22.

Furthermore, in the pump 1 according to the present embodiment, the discharge passage 22 is formed having a diameter greater than the diameter of the inlet passage 21. In other words, the inlet passage 21 overlaps the discharge passage 22 or is positioned radially inward of the discharge passage 22 as viewed in the axial direction. Therefore, the inlet passage 21 can be made compact in the radial direction. Thus, the casing 11 can be made compact.

Furthermore, in the pump 1 according to the present embodiment, each of the plurality of discharge-end branch portions 22*b* extends from a corresponding one of the plurality of cylinder bores 12*b* toward the discharge-end ring-shaped portion 22*a*. Therefore, the discharge-end ring-shaped portion 22*a* can be formed radially outward of the plurality of cylinder bores 12*b* at a distance therefrom.

Furthermore, in the pump 1 according to the present embodiment, the discharge-end branch portions 22*b* extend radially from the cylinder bores 12*b*, are further bent, and extend in the one axial direction toward the discharge-end ring-shaped portion 22*a*. Therefore, the discharge-end ring-shaped portion 22*a* can be formed at a distance in the one axial direction from the radially extending portions of the discharge-end branch portions 22*b*. Thus, the strength of the pump 1 can be secured.

Furthermore, in the pump 1 according to the present embodiment, the discharge check valves 17 are disposed between the discharge-end ring-shaped portion 22*a* and the inlet-end ring-shaped portion 21*b* in the axial direction. Therefore, the discharge-end ring-shaped portion 22*a* and the inlet-end ring-shaped portion 21*b* are formed apart from each other. Thus, the strength of the pump 1 can be secured.

Furthermore, in the pump 1 according to the present embodiment, the discharge port 22*c* is disposed at a position at which the pulsations of the working fluid discharged from the plurality of cylinder bores 12*b* are canceled out. Therefore, it is possible to minimize the pulsations of the working fluid discharged from the pump 1.

Furthermore, in the pump 1 according to the present embodiment, the discharge passage 22 is formed in the shape of a ring. Therefore, the pulsations of the working fluid discharged from the plurality of cylinder bores 12*b* can be cancelled out. Thus, it is possible to reduce the occurrence of pulsations of the working fluid discharged. Furthermore, the discharge passage 22 exteriorly surrounds the plurality of cylinder bores 12*b*. Therefore, the cylinder bores 12*b* can be cooled from the outside using the working fluid flowing in the discharge passage 22.

Other Embodiments

The pump 1 according to the present embodiment does not necessarily need to include the variable capacity mechanism 15. It is sufficient that the variable capacity mechanism 15 be capable of changing the effective stroke length S of at least one piston 14. The shapes of the inlet passage 21 and the discharge passage 22 in the pump 1 are merely one example and may be other shapes. For example, the inlet passage 21 and the discharge passage 22 do not necessarily need to be both in the shape of a ring; it is sufficient that at least one of the inlet passage 21 and the discharge passage 22 be in the shape of a ring. The other of the inlet passage 21 and the discharge passage 22 may be individually formed for each of the cylinder bores 12*b*. Furthermore, the inlet passage 21 does not necessarily need to include the communication chamber 21*d*, and each of the communication portions 21*c* may be connected to a corresponding one of the drain openings 12*i*. Furthermore, in the discharge passage 22, the discharge-end branch portions 22*b* do not necessarily need to be bent. For example, the discharge-end ring-shaped portion 22*a* may be formed radially outward of the discharge-end branch portions 22*b*.

From the foregoing description, many modifications and other embodiments of the present invention would be obvious to a person having ordinary skill in the art. Therefore, the foregoing description should be interpreted only as an example and is provided for the purpose of teaching the best mode for carrying out the present invention to a person having ordinary skill in the art. Substantial changes in details of the structures and/or functions of the present invention are possible within the spirit of the present invention.

REFERENCE CHARACTER LIST

1 rotary swash plate hydraulic pump
11 casing
12 cylinder block
12*a* one end surface
12*b* cylinder bore
12*c* spool hole
12*f* the other end surface
13 rotary swash plate
14 piston
15 variable capacity mechanism
19 tank
21 inlet passage
21*a* inlet port
21*b* inlet-end ring-shaped portion
21*c* communication portion
21*d* communication chamber
22 discharge passage
22*a* discharge-end ring-shaped portion
22*b* discharge-end branch portion
22*c* discharge port
25 spool
27 swash plate rotating shaft

The invention claimed is:

1. A rotary swash plate hydraulic pump comprising:

a casing;

a cylinder block that is disposed in the casing so as to prevent relative rotation of the cylinder block and including a plurality of cylinder bores;

a plurality of pistons each of which is inserted into a corresponding one of the plurality of cylinder bores;

a rotary swash plate that is housed in the casing so as to be rotatable about an axis and reciprocates each of the plurality of pistons; and a variable capacity mechanism that changes an effective stroke length of at least one of the plurality of pistons, wherein:

the casing includes an inlet passage including an inlet-end ring-shaped portion in the shape of a ring to which each of the plurality of cylinder bores is connected;

the variable capacity mechanism includes a plurality of spools that open and close paths between the plurality of cylinder bores and a tank;

the cylinder block includes a plurality of spool holes into each of which a corresponding one of the plurality of spools is inserted; and each of the plurality of spools is positioned inward of the plurality of cylinder bores and connected to the inlet-end ring-shaped portion.

2. The rotary swash plate hydraulic pump according to claim 1, wherein:

the inlet passage further includes a plurality of communication portions and a communication chamber;

each of the plurality of communication portions is connected to the inlet-end ring-shaped portion; and the communication chamber is positioned inward of the inlet-end ring-shaped portion so as to overlap the plurality of spool holes as viewed in an axial direction, and is connected to the inlet-end ring-shaped portion via the plurality of communication portions.

3. The rotary swash plate hydraulic pump according to claim 1, wherein:

the inlet passage includes a plurality of inlet ports that draw in a working fluid.

4. The rotary swash plate hydraulic pump according to claim 1, wherein:

the casing includes a discharge passage including a discharge-end ring-shaped portion in the shape of a ring to which each of the plurality of cylinder bores is connected.

5. The rotary swash plate hydraulic pump according to claim 4, wherein:

the discharge passage is offset with respect to the inlet passage in an axial direction.

6. The rotary swash plate hydraulic pump according to claim 4, wherein:

the discharge passage exteriorly surrounds the plurality of cylinder bores.

7. The rotary swash plate hydraulic pump according to claim 6, wherein:

an outermost diameter of the discharge passage is set to be greater than an outermost diameter of the inlet passage.

8. The rotary swash plate hydraulic pump according to claim 6, wherein:

the discharge passage further includes a plurality of discharge-end branch portions; and each of the plurality of discharge-end branch portions extends from a corresponding one of the plurality of cylinder bores toward the discharge-end ring-shaped portion.

9. The rotary swash plate hydraulic pump according to claim 8, wherein:

each of the plurality of discharge-end branch portions extends radially outward from the corresponding one of the plurality of cylinder bores, is further bent, and extends toward the discharge-end ring-shaped portion in an axial direction.

10. The rotary swash plate hydraulic pump according to claim 8, further comprising:

a plurality of discharge check valves each of which is provided on a corresponding one of the plurality of discharge-end branch portions, allows a flow of a working fluid in one direction from a corresponding one of the plurality of cylinder bores to the discharge-end ring-shaped portion, and blocks an opposite flow of the working fluid, wherein:

each of the plurality of discharge check valves is disposed between the discharge-end ring-shaped portion and the inlet passage in an axial direction.

11. The rotary swash plate hydraulic pump according to claim 8, wherein:

the discharge passage includes a discharge port that discharges a working fluid and a merge portion connecting the discharge-end ring-shaped portion and the discharge port; and the merge portion is disposed at a position at which pulsations of the working fluid discharged from the plurality of cylinder bores are canceled out.

12. A rotary swash plate hydraulic pump comprising:

a casing;

a cylinder block that is disposed in the casing so as to prevent relative rotation of the cylinder block and including a plurality of cylinder bores;

a plurality of pistons each of which is inserted into a corresponding one of the plurality of cylinder bores;

a rotary swash plate that is housed in the casing so as to be rotatable about an axis and reciprocates each of the plurality of pistons; and a variable capacity mechanism that changes an effective stroke length of at least one of the plurality of pistons, wherein:

the casing includes a discharge passage connected to each of the plurality of cylinder bores, and an inlet passage including an inlet-end ring-shaped portion in the shape of a ring to which each of the plurality of cylinder bores is connected;

the discharge passage is formed in the shape of a ring so as to surround the plurality of cylinder bores;

the variable capacity mechanism includes a plurality of spools that open and close paths between the plurality of cylinder bores and a tank;

the cylinder block includes a plurality of spool holes into each of which a corresponding one of the plurality of spools is inserted; and each of the plurality of spools is positioned inward of the plurality of cylinder bores and connected to the inlet passage.

* * * * *